US010406395B2

(12) United States Patent
Haas

(10) Patent No.: US 10,406,395 B2
(45) Date of Patent: Sep. 10, 2019

(54) CALF RAISE EXERCISE DEVICE

(71) Applicant: Jackson H. Haas, Columbus, OH (US)

(72) Inventor: Jackson H. Haas, Columbus, OH (US)

( * ) Notice: Subject to any disclaimer, the term of this patent is extended or adjusted under 35 U.S.C. 154(b) by 0 days.

(21) Appl. No.: 15/438,332

(22) Filed: Feb. 21, 2017

(65) Prior Publication Data

US 2017/0239507 A1 Aug. 24, 2017

Related U.S. Application Data

(60) Provisional application No. 62/297,945, filed on Feb. 21, 2016.

(51) Int. Cl.
*A63B 21/00* (2006.01)
*A63B 21/055* (2006.01)
(Continued)

(52) U.S. Cl.
CPC .... *A63B 21/00061* (2013.01); *A63B 21/0442* (2013.01); *A63B 21/0552* (2013.01); *A63B 21/0557* (2013.01); *A63B 21/4013* (2015.10); *A63B 23/03541* (2013.01); *A63B 23/0458* (2013.01); *A63B 23/08* (2013.01); *A63B 21/0555* (2013.01); *A63B 2023/006* (2013.01);
(Continued)

(58) Field of Classification Search
CPC ..... A63B 21/00061; A63B 21/0442; A63B 21/0557; A63B 21/4013; A63B 21/0552; A63B 21/05555; A63B 23/08; A63B 23/0458; A63B 23/03541; A63B 2023/006; A63B 2071/027; A63B 2225/09; A63B 2209/10; A63B 2208/0204
See application file for complete search history.

(56) References Cited

U.S. PATENT DOCUMENTS 4,340,218 A * 7/1982 Wilkinson ..... A63B 21/00047 482/129
6,220,994 B1 * 4/2001 Rich ..... A63B 21/0004 482/123
(Continued)

*Primary Examiner* — Megan Anderson
(74) *Attorney, Agent, or Firm* — Miracle IP; Bryce D. Miracle

(57) ABSTRACT

In accordance with the invention, a uniquely constructed, lightweight calf raise exercise device is provided which is user friendly, portable, and inexpensive—providing athletes with the ability to effectively strengthen leg muscles without going to the gym, which is optimal for the busy lifestyle. The calf raise device generally includes a platform assembly having a length extending between a front side and a rear side, the platform assembly including a first surface extending a segment of the length from the front side and an elevated second surface extending the remainder of the length between the first surface and the rear side, wherein the first surface is configured to support the user's heels during operation and the second surface is configured to support the user's toes during operation and throughout the motion of the calf raise. The calf raise device also includes at least two ankle cuffs configured to receive the ankles of the user wearing the calf raise device and at least two elastic resistance members operably connecting the platform assembly with the at least two ankle cuffs respectively. The elastic resistance members are configured to provide resistance throughout the motion of the calf raise.

5 Claims, 7 Drawing Sheets

(51) Int. Cl.

| | |
|---|---|
| ***A63B 21/04*** | (2006.01) |
| ***A63B 23/035*** | (2006.01) |
| ***A63B 23/04*** | (2006.01) |
| ***A63B 23/08*** | (2006.01) |
| *A63B 23/00* | (2006.01) |
| *A63B 71/02* | (2006.01) |

(52) U.S. Cl.
CPC . *A63B 2071/027* (2013.01); *A63B 2208/0204* (2013.01); *A63B 2209/10* (2013.01); *A63B 2225/09* (2013.01)

(56) References Cited

U.S. PATENT DOCUMENTS

| | | | | |
|---|---|---|---|---|
| 7,785,243 | B2 * | 8/2010 | Kassel | A63B 21/00185 482/121 |
| 8,118,599 | B2 * | 2/2012 | Lipetz | A63B 69/0022 434/255 |
| 9,415,260 | B2 * | 8/2016 | Islas | A63B 23/10 |
| 2009/0111669 | A1 * | 4/2009 | Richter | A63B 21/00047 482/142 |
| 2010/0167885 | A1 * | 7/2010 | Kassel | A63B 21/00043 482/121 |
| 2013/0090216 | A1 * | 4/2013 | Jackson | A63B 21/018 482/52 |
| 2015/0297128 | A1 * | 10/2015 | Shield | A61B 5/224 600/595 |

* cited by examiner

CALF RAISE EXERCISE DEVICE

RELATED APPLICATION

The present application claims priority to, and the benefits of, U.S. Provisional Application Ser. No. 62/297,945, filed Feb. 21, 2016, the entire disclosure of which is hereby incorporated by reference.

BACKGROUND

The present invention relates to exercise equipment, in particular, to an improved, portable, lightweight calf raise device.

By way of background, calf raises are a method of exercising the gastrocnemius, tibialis posterior and soleus muscles of the lower leg. The movement that is performed is technically labeled plantar flexion and commonly known as ankle extensions or calf raises. The exercise can be performed either by standing or while in the seated position such as a bent-knee calf raise.

Currently in the art, calf raise machines are only designed for commercial use in gyms and not for compact home personal use. Typically, machines designed to assist in performing the calf raise are awkwardly shaped, of larger size which make them difficult to move, and are extremely expensive—making them impractical and expensive for home use purposes.

Basketball players and other athletes often desire to improve their leg strength thereby increasing their ability to vertically jump in the air which provides them with an advantage on the court. Often athletes desire to work on the calf area muscle group without the need to travel to a gym or pay membership dues for equipment that they do not need. Many athletes would like the ability to work on their vertical jumping ability which fits their busy schedule without incurring the cost of a gym membership or purchasing heavy equipment for home use.

For the foregoing reasons, there is a need for an improved calf raise machine which is easy to use, portable, efficient, and adaptive with the lifestyle of today's athletes.

SUMMARY

In accordance with the invention, a uniquely constructed, lightweight calf raise exercise device is provided which is user friendly, portable, and inexpensive—providing athletes with the ability to effectively strengthen leg muscles without going to the gym, which is optimal for the busy lifestyle.

In a version of the invention, the calf raise device generally comprises: (a) a platform assembly having a length extending between a front side and a rear side, the platform assembly comprising a first surface extending a segment of the length from the front side and an elevated second surface extending the remainder of the length between the first surface and the rear side, wherein the first surface is configured to support the user's heels during operation and the second surface is configured to support the user's toes during operation and throughout the motion of the calf raise; (b) at least two ankle cuffs configured to receive the ankles of the user wearing the calf raise device; and (c) at least two elastic resistance members operably connecting the platform assembly with the at least two ankle cuffs respectively, the elastic resistance members are configured to provide resistance throughout the motion of the calf raise. Preferably, the length of the second surface is less than the length of the first surface.

In a version, the platform assembly is formed by a unitary continuous sheet of rigid material, thereby providing a lightweight and portable device while reducing the overall costs of manufacturing.

In a version, the first surface and second surface have either a raised textured pattern or an anti-slip material for providing traction when utilizing the calf raise device.

In yet another version, the calf raise device may further comprise a first base support and a second base support for supporting the platform assembly on a flat surface, the first base support positioned at the front side of the platform assembly and the second base support positioned at the rear side of the platform assembly.

Further, in yet another version of the invention, each ankle cuff may include an interior and an exterior surface having a hook and loop type fastener for securing to the ankle of the user, the interior having a padding material for providing comfort while worn and the exterior having an elastic resistance member connection ring.

In an optional detailed version, each elastic resistance member comprises a length of elastic material terminating at a first end and a second end, a first connection means positioned at the first end and a second connection means positioned at the second end, wherein the first connection means is attachably removable to the platform assembly and the second connection means is attachably removable to the ankle cuff.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

Referring now to the figures wherein the showings are for purposes of illustrating a preferred version of the invention only and not for purposes of limiting the same, the present invention relates to a calf raise exercise device which is compact, lightweight, and portable. The calf raise exercise device is particularly suited for home use by busy athletes of all types who simply desire to strengthen their lower legs without the need for costly equipment or the need to run to the gym.

With that said, the following detailed description is of the best currently contemplated modes of carrying out exemplary versions of the invention. The description is not to be taken in the limiting sense, but is made merely for the purpose illustrating the general principles of the invention, since the scope of the invention is best defined by the appended claims.

Various inventive features are described below that can each be used independently of one another or in combination with other features.

Figure 1:
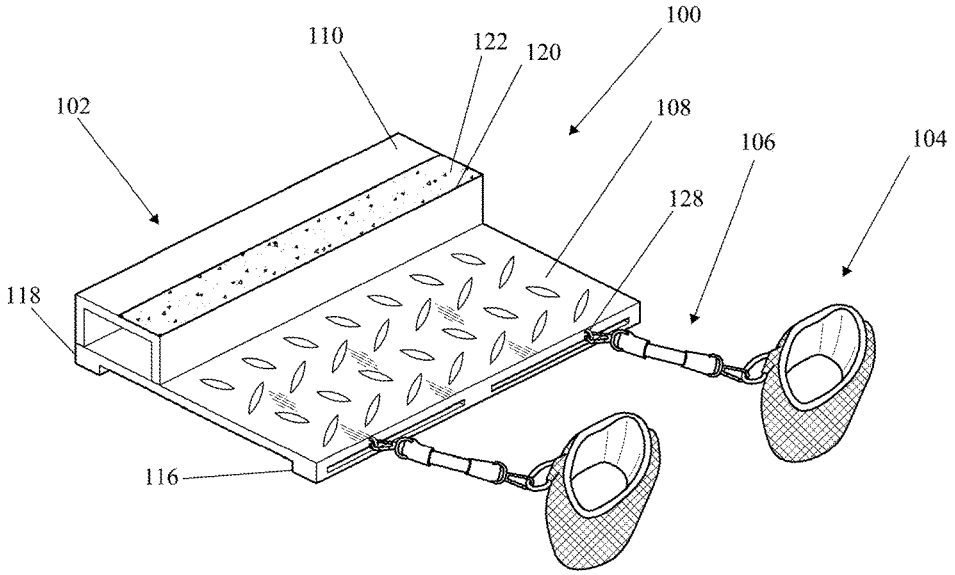
FIG. 1 is perspective view of a version of the application.

With reference to the figures, particularly FIG. 1, a description of a version of the invention will be provided and is generally designated as numeral 100. FIG. 1 is a front perspective view of a first version of the calf raise exercise device 100 as positioned on a ground surface or otherwise a flat surface sufficient to support the weight of a person. Generally, the calf raise device 100 comprises a platform assembly 102, at least two ankle cuffs 104A, B configured to receive the ankles 30 of a user (See FIG. 10), and at least two corresponding elastic resistance members 106A, B connecting the platform assembly 102 with the corresponding ankle cuffs 104A, B for providing resistance throughout the motion of the exercise which will be described in detail below.

As best illustrated by FIG. 1-FIG. 11, a first version of the platform assembly 102 generally comprises a first lower surface 108 and a second elevated surface 110. The first lower surface 108 is configured to provide a flat platform surface to receive and support the heels 60 of a user and the second elevated surface 110 is configured to provide an elevated platform for supporting the ball and toes 50 of the user during operation.

In the illustrated version, the platform assembly 102 is substantially configured to provide a standing surface area in a rectangular shape having a width W and a length L1. The length L1 (FIG. 4) extending between a front perimeter 112 to a rear perimeter 114. The first lower surface 108 extends from the front perimeter 112 for a first segment L2 of the overall length L1. The second elevated surface 110 is positioned in an elevated configuration which extends the remaining length L3 of the overall length L1 between the first lower surface 108 and the rear perimeter 114. Other shaped configurations can certainly be envisioned to carry out the function of the calf raise device having a first lower surface 108 and a second elevated surface 110.

The following dimensions and ratio attributes of the platform assembly are specifically designed and optimally configured to provide superior comfort for the user athlete, ease of functionality, and maximize the results from the calf raise exercise movement. These dimensions specifically formulate optimal dimensions for elevation of the toes 50 on the elevated surface 110 positioning them above the heels 60 while positioning the ankle cuffs 104 in combination with the elastic resistance members 106 above the lower surface 108. For illustrative purposes see FIG. 10 and FIG. 11.

In the illustrated version, the length L3 (FIG. 4) of the second elevated surface is less than the length L2 of the lower first surface. This provides more platform area for supporting the ankle 30 and the heel 60 portion of the user's foot 40 and less space for the toes of the user which require less platform area during operation of the calf raise exercise device 100. Preferably, the range of length L1 of the platform assembly 102 is between 10 and 13 inches, ideally 11.5 inches. Preferably, the width W of the platform assembly 102 is between 10 and 14 inches, preferably 12 inches. Preferably, the length L2 of the lower surface 108 is between 6 and 10 inches, ideally 8 inches and the length L3 of the elevated surface 110 is between 2 and 5 inches, ideally 3.5 inches. Ideally, the height 113 of the lower surface 108 with reference to the ground surface is at least ½ inch, most preferably 1 inch. See FIG. 3.

Preferably, the second elevated surface 110 is elevated above the first lower surface 108 at a height 112. Preferably, the height 112 is at least 1.5 to 3 inches, ideally 2.5 inches. Furthermore, the height H1 (FIG. 2) of the elevated surface 110 in relation to the ground surface is preferably at least 3 to 5 inches, ideally 3.5 inches.

Figure 2:
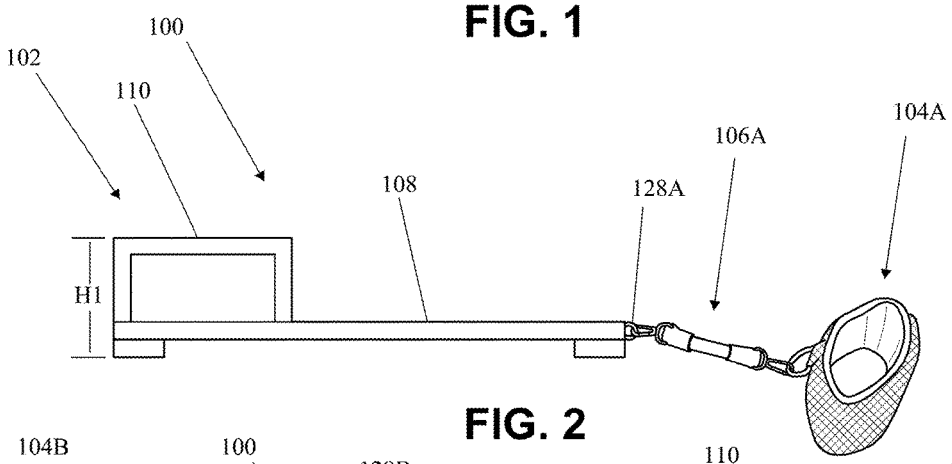
FIG. 2 is a left side elevation view of the version shown in FIG. 1.
Figure 3:
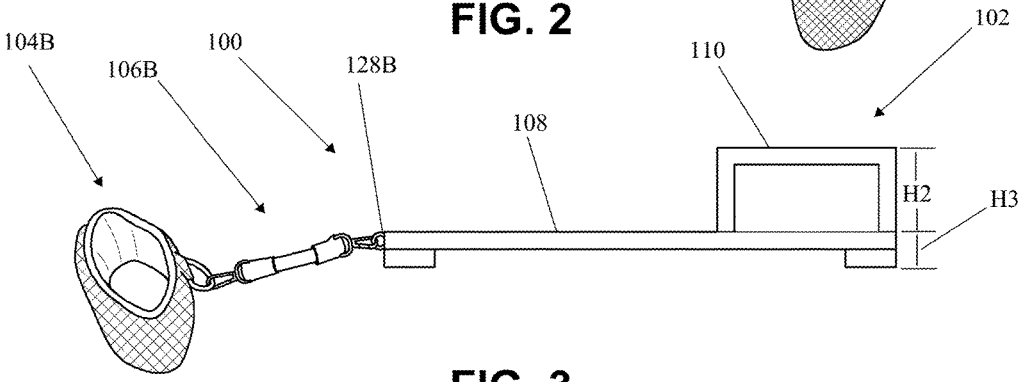
FIG. 3 is a right side elevation view of the version shown in FIG. 1.

As best illustrated by FIG. 2 and FIG. 3, the platform assembly 102 may be best supported on the ground by utilizing two or more base support members 116, 118 which are positioned along the front perimeter 112 and at the rear perimeter 114 for providing lateral and longitudinal support in conjunction the ground or other flat surface.

As best illustrated by FIG. 1-FIG. 3, and FIG. 9, the platform assembly comprises a pair of connection rings 128A, 128B for positioning and connection of the elastic resistance members 106A, 106B. The connection rings 128A, 128B are symmetrically positioned laterally near the front perimeter 112 of the lower surface 108. In particular, the connection rings 128A and 128B are centrally aligned with the rear of the user's heel 60 while in operation.

Figure 12:
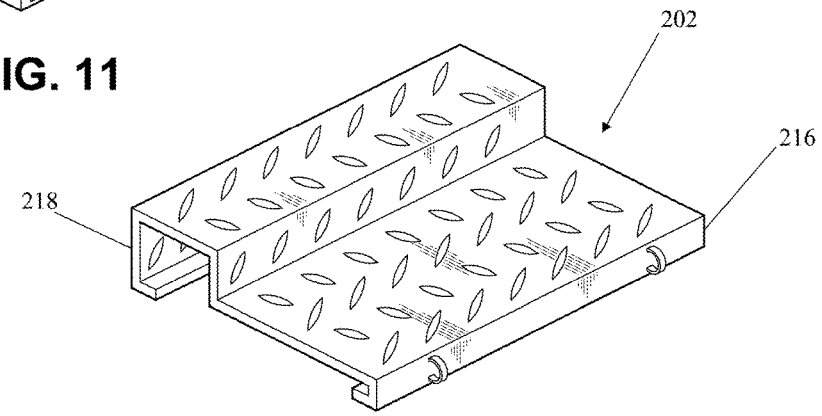
FIG. 12 is a front perspective view of a second version of the platform assembly.
Figure 13:
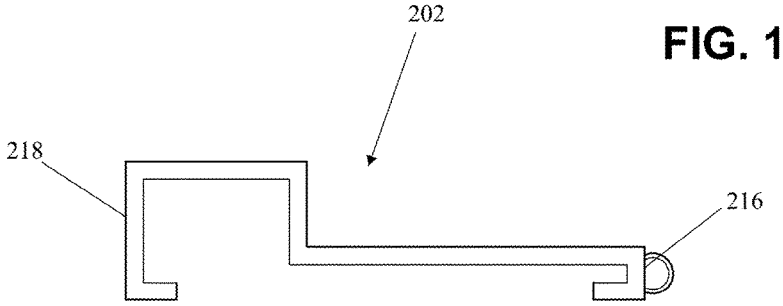
FIG. 13 is a left side elevation view of the version shown in FIG. 12.
Figure 14:
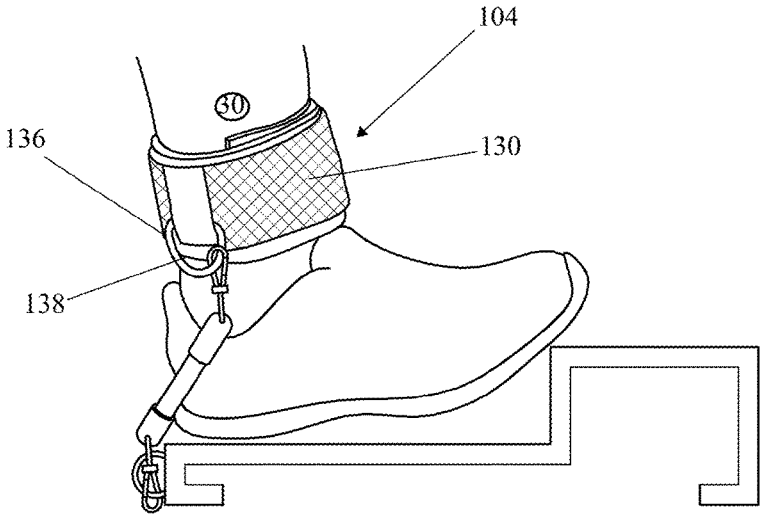
FIG. 14 is an illustrative right side elevation view of the version shown in FIG. 12.
Figure 15:
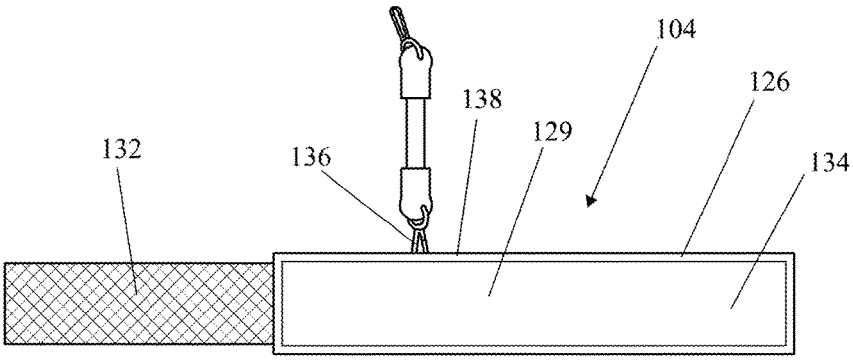
FIG. 15 is an interior plan view of a version of the ankle cuff and elastic resistance member.
Figure 16:
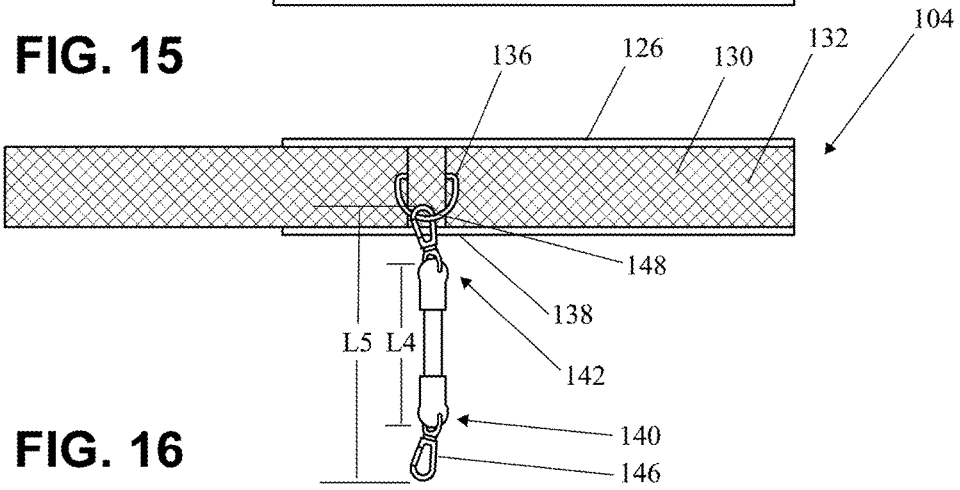
FIG. 16 is an exterior plan view of the version of the ankle cuff and elastic resistance member shown in FIG. 15.
Figure 17:
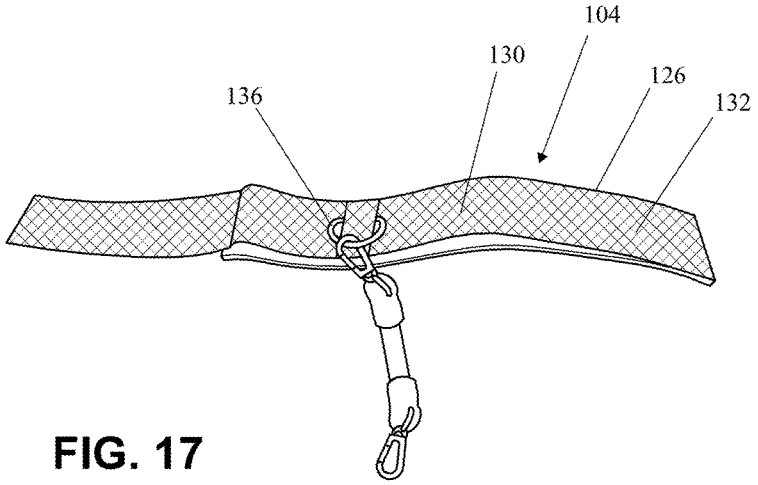
FIG. 17 is a perspective view of the version of the ankle cuff and elastic resistance member shown in FIG. 15.

In a second version of the platform assembly as best illustrated by FIG. 12 and FIG. 13, the platform assembly 202 is constructed of a single unitary, continuous sheet of material. Ideally, the platform assembly 202 is made of a lightweight metal such as aluminum or a hardened plastic. The single unitary and continuous construction reduces the amount of materials need for construction and is more favorable for manufacturing—due to the reduced amount of independent parts. The version of the platform assembly 202 can be easily manufactured by utilizing and bending a single piece of metal or only utilizing a single injection molding regarding plastic construction such as polypropylene (PP) or polyvinylidene chloride (PVC). Preferably, one sheet of diamond plated aluminum is utilized. The sheet is initially cut into a rectangular configuration which is bent to the above described dimensions regarding platform assembly 102 during manufacturing, thereby mitigating manufacturing costs and reducing the weight of the overall device.

Figure 18:
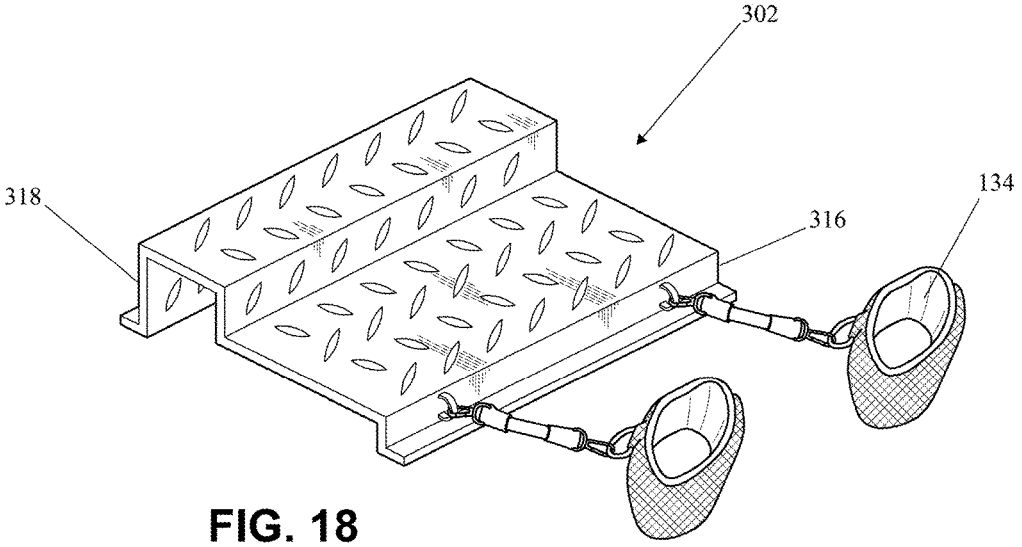
FIG. 18 is a front perspective view showing a version of the platform assembly.
Figure 19:
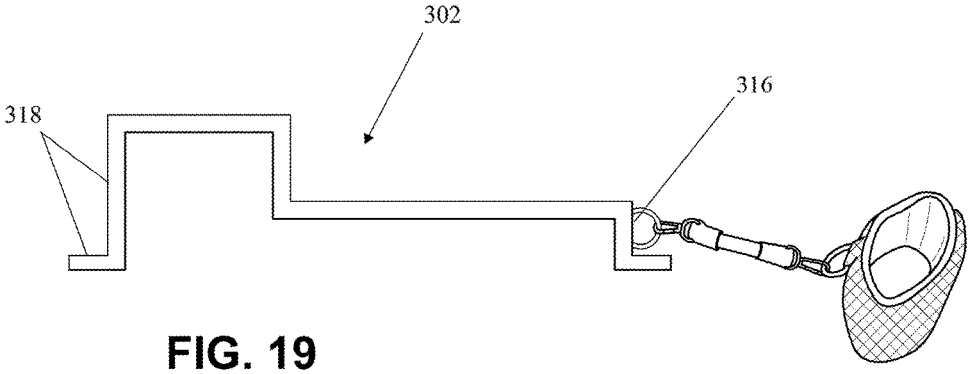
FIG. 19 is a left side elevation view of the version shown in FIG. 18.

As illustrated by the elevation view in FIG. 13, the version of the platform assembly 202 includes a front support member 216 and a rear support member 218 which provide lateral and longitudinally support of the platform assembly 202 while supporting the user thereon. In the version, the front and rear support members 216, 218 each include inward extending feet, which form an L shaped cross section, which provide an increase of surface area in contact with the ground surface. Other versions of the support members can be envisioned such as the version of the platform assembly 302 illustrated in FIG. 18 and FIG. 19, wherein each front 316 and rear support members 318 each include outward extending feet having an L shaped cross section for providing superior support.

Figure 4:
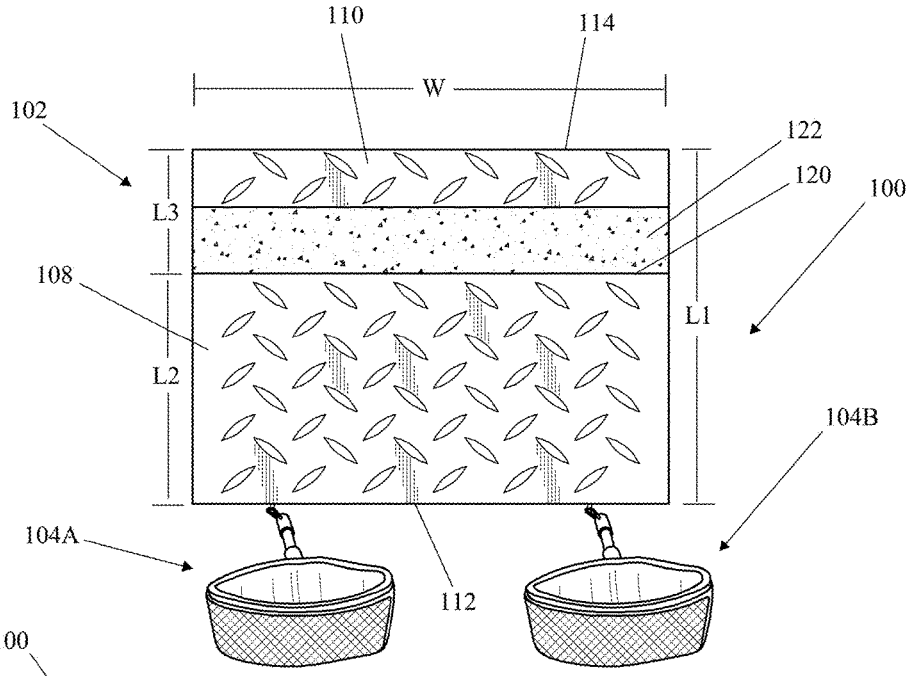
FIG. 4 is a top plan view of the version shown in FIG. 1.
Figure 5:
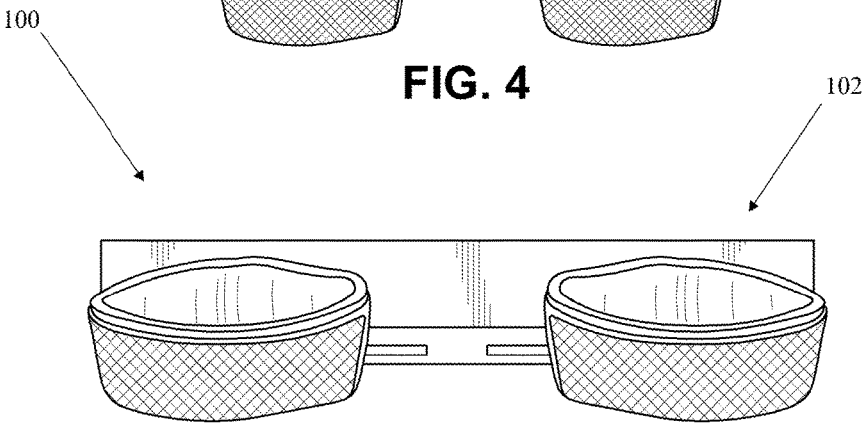
FIG. 5 is a front elevation view of the version shown in FIG. 1.
Figure 6:
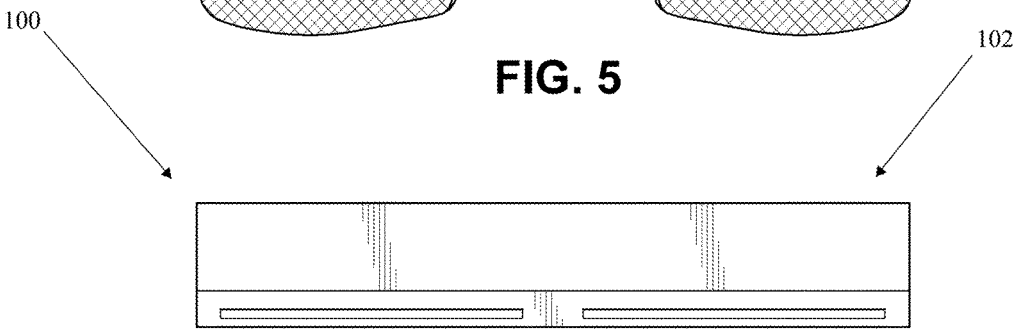
FIG. 6 is a rear side elevation view of the version shown in FIG. 1.
Figure 7:
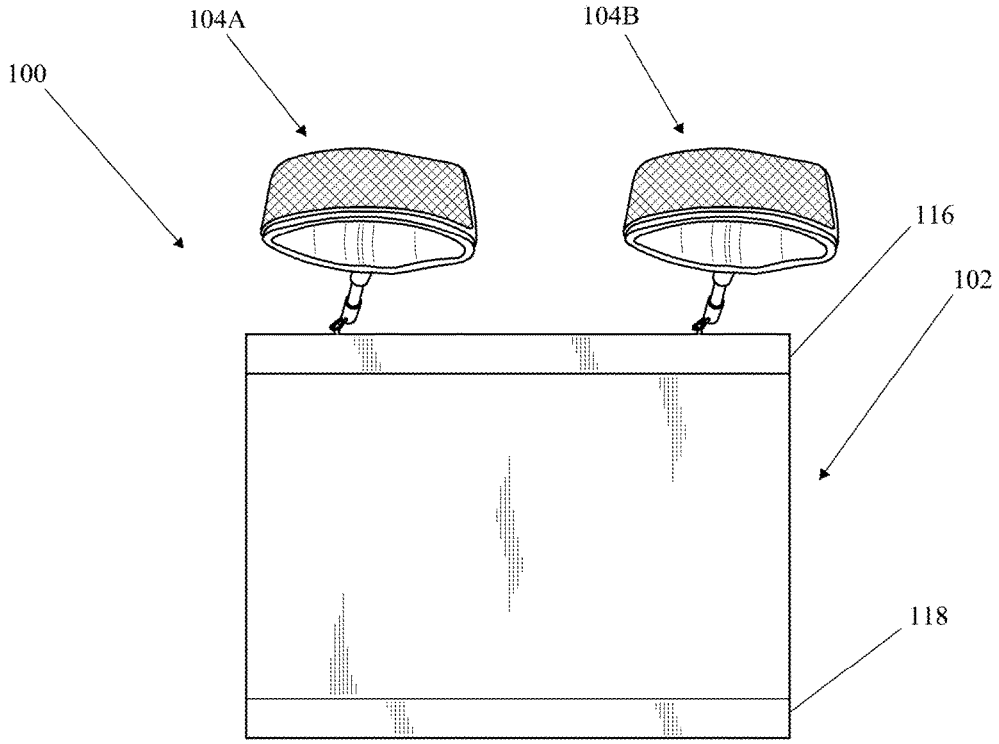
FIG. 7 is a bottom plan view of the version shown in FIG. 1.
Figure 8:
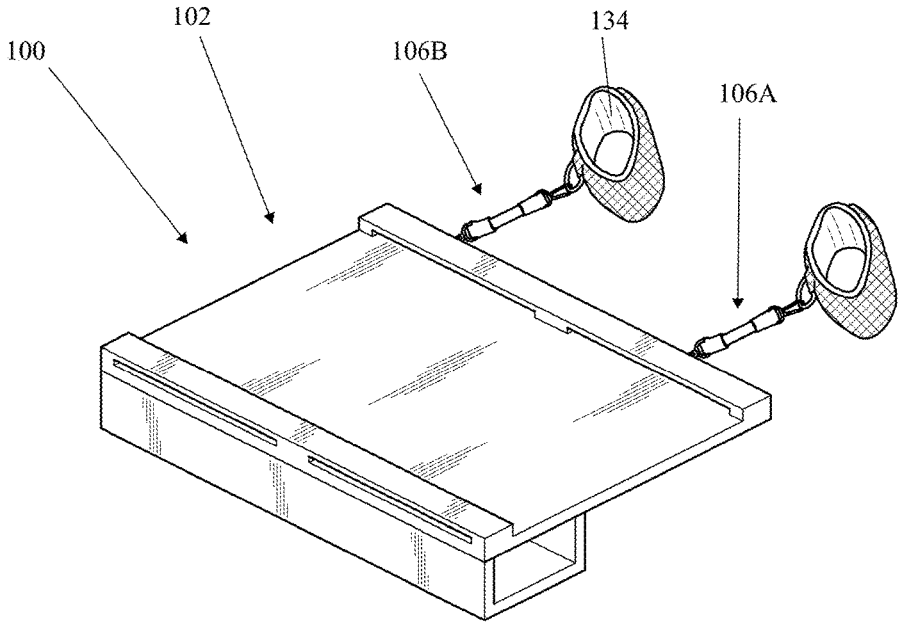
FIG. 8 is a bottom perspective view of the version shown in FIG. 1.

In a preferred version, as best illustrated by FIG. 1 and FIG. 4, a non-slip texture 122 is provided on the elevated surface 110 which extends from near the front perimeter 120 of the elevated surface 110 for at least a segment of the length L3 thereof. For example, the non-slip texture 122 can be a non-slip tape material made of a silicon carbide. In particular, the non-slip texture 122 provides a gripping segment which is suited to grip the toe portion 50 of the user's feet 40 during operation of the calf raise exercise device 100, thereby improving safety. Moreover, the lower surface 108 can also boast a textured surface 124 which provides a superior gripping action in conjunction with the heel 60 portion of the user's foot 40. In the illustrated version, the textured surface 124 is an integral texture pattern of the native construction material of the platform assembly 102 as originally molded, for example the diamond plating disclosed above. Alternatively, other materials which provide a non-slip surface may be utilized such as the non-slip tape made of silicon carbide described above.

Figure 11:
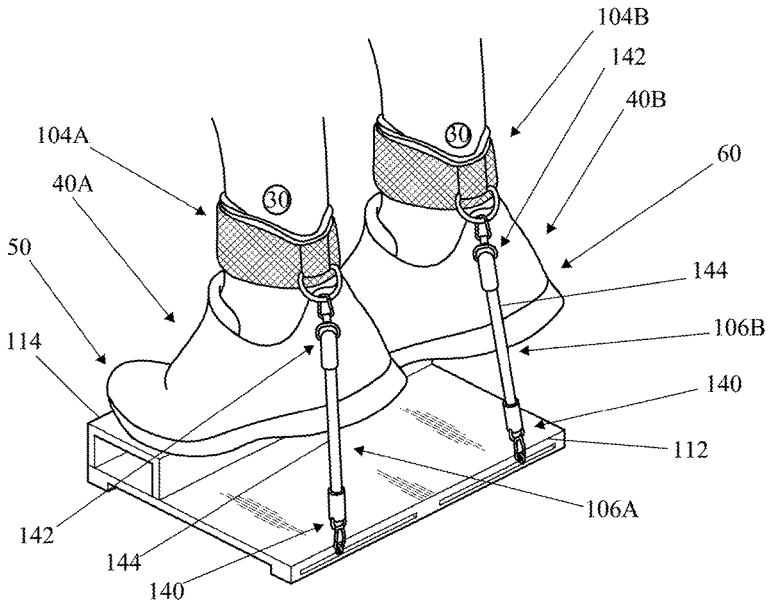
FIG. 11 is an illustrative perspective view showing use of the version shown in FIG. 1.

With reference to the figures, particularly FIG. 14-FIG. 17, the ankle cuffs 104 will be described in detail. In the illustrated version, the ankle cuffs 104 generally comprise a unitary elongated rectangular portion 126 having an interior surface 129, an exterior surface 130, and a connection ring 136. The elongated rectangular portion 126 is generally flexible in nature and is configured to secure to the ankle 30 of the user during operation. The interior surface 129 and the exterior surface 130 are equipped with reciprocal hook and loop fasteners 132 utilized to secure the ankle cuff 104 to the respective ankle 30. Moreover, in a version, the ankle cuff 104 interior surface 129 may be lined with an interior padding 134 for providing a more comfortable fit about the user's ankle 30. The connection ring 136 is ideally located near the bottom perimeter 138 and configured to be centrally positioned at the rear of the user's ankle 30 while worn as illustrated in FIG. 11.

Now referring to FIG. 9-FIG. 11, FIG. 16, the elastic resistance members 106A, B are generally configured to connect the ankle cuffs 104 with the platform assembly 102 and provide resistance throughout the motion of the calf raise exercise. In further detail, the elastic resistance members 106A, B are generally an elastic body that returns to its original shape after deformation such as a polymer, rubber, or latex material or spring. In the illustrated version, the elastic resistance members generally comprise a length L4 of elastic tubing 144 or band terminating at a first free end 140 and a second free end 142. Ideally the length L4 is configured to be of sufficient length not to be engaged under tension when the user's heel 60 is positioned flat on the lower surface 108. Preferably, the length L4 of the elastic resistance member 106 is at least 3 inches, more preferably 3.54 inches (9 cm). Preferably, the length L4 is configured so that the elastic resistance member 106 begins to stretch and provide resistance immediately after the user initiates lifting the heel 60 off the lower surface 108.

Figure 9:
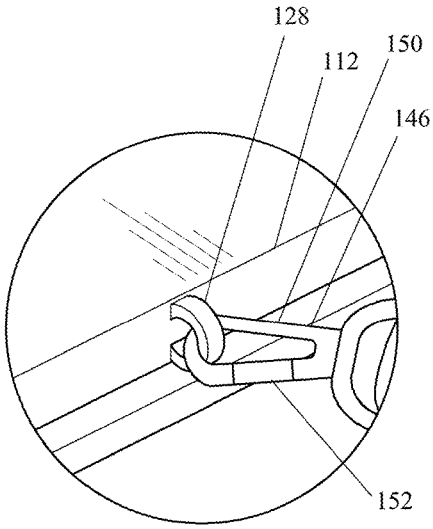
FIG. 9 is an up-close view of the connection assembly of the version shown in FIG. 1.

In the illustrated version, a first connection means 146 is positioned at the first free end 140 of the elastic tubing 144 and a second connection means 148 is positioned at the second free end 142. The first and second connection means 146, 148 can be a caribiner configuration or a ring 150 with a hinged gate 152 is preferable (FIG. 9). The connection means 146, 148 are configured to be attachably removable so that the elastic resistance members 106 are easily attached and removed between the platform assembly 102 and the ankle cuffs 104. In the version, the connection means 146, 148 located at opposing ends 140, 142 attach to the connection ring 128 of the platform assembly 102 and the connection ring 136 of the ankle cuffs 104 respectively. The collective length L5 (FIG. 16) of the elastic tubing 144, the first connection means 146, and the second connection means 148 is preferably between 5 and 7 inches, preferably 6 inches.

It is highlighted that varying degrees of resistance strengths of the elastic resistance members 106 can be utilized in order to increase the resistance throughout the workout or increase the resistance overtime to accommodate strength gains and further challenge the muscle group. Moreover, one or more elastic resistance members 106 can by combined or "doubled up" at each ankle cuff 104 in order to increase the resistance load. Preferably, the resistance load of each elastic resistance member 106 is safe and effective for the calf raise exercise movement. Ideally, latex tubing is utilized which has an internal diameter of at least 6 mm and an external diameter of at least 12 mm. The latex external diameter can be increased to increase the resistance load or decreased to decrease the resistance load depending on the athlete's needs.

Figure 10:
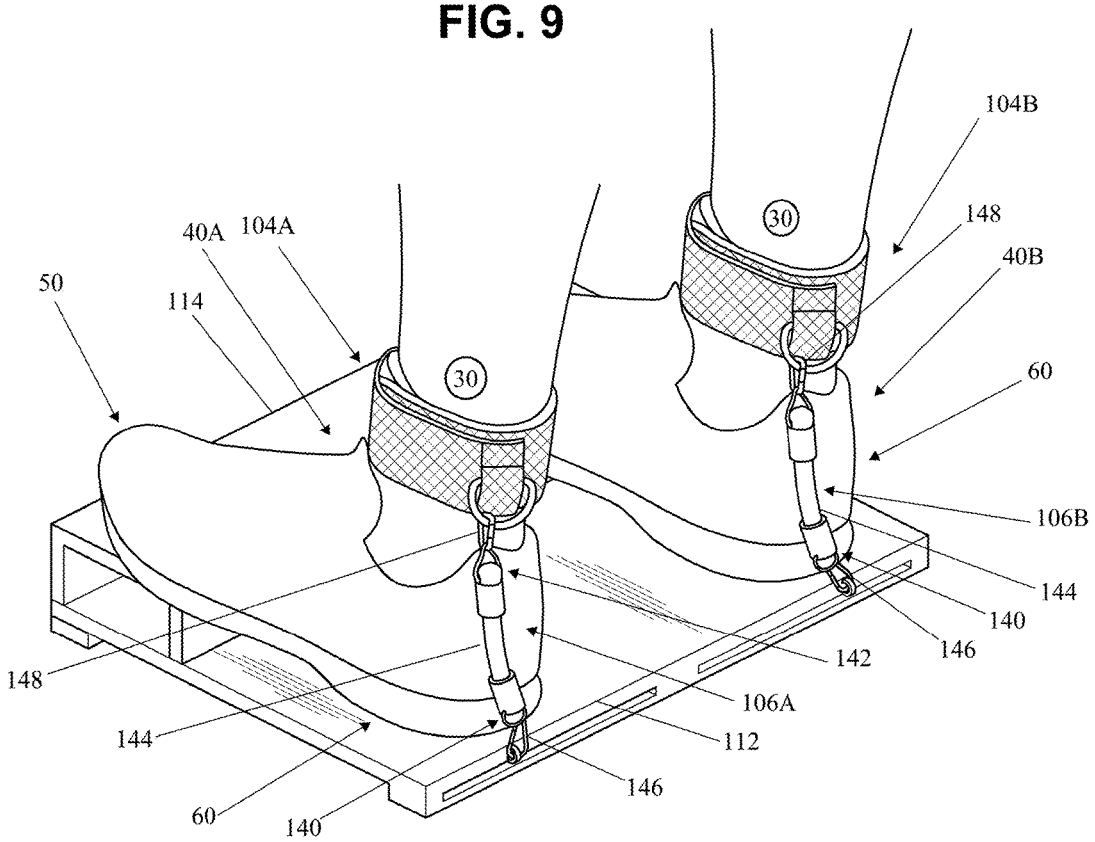
FIG. 10 is an illustrative perspective view showing use of the version shown in FIG. 1.

FIG. 10 and FIG. 11 illustrate use of the calf raise exercise device 100. The user initially places the exercise device 100 on a flat supportive surface. Ankle cuffs 104 are each attached at each respective user ankle 30. Each ankle cuff 104 is attached to the respective platform assembly 102 via the respective elastic resistance member 106. The user then steps on to the platform assembly 102, placing both feet 40 aligned forward towards the rear of the platform assembly 102 and rear perimeter 114, positioning the toes 50 on the elevated surface 110 and the heels 60 on the lower surface 108. The user is now ready to perform the calf raise exercise by repeatedly elevating the heels 60 from the lower platform 10 to an elevated position above the elevated surface 110 in successive reps according to the user's workout plan which can vary between athletes and desired results.

The calf raise device 100 can be made in any manner and of any material chosen with sound engineering judgment. Preferably, materials will be strong, lightweight, long lasting, economic, and ergonomic.

The invention does not require that all the advantageous features and all the advantages need to be incorporated into every version of the invention.

Although preferred embodiments of the invention have been described in considerable detail, other versions and embodiments of the invention are certainly possible. Therefore, the pre-sent invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A calf raise device for exercising calf muscles of a user comprising:

a platform assembly comprising a first lower surface and a second elevated surface, wherein the first lower surface is configured to support the user's heels during operation and the second surface is configured to support the user's toes during operation throughout a motion of the calf raise;

at least two ankle cuffs configured to receive the ankles of the user; and at least two elastic resistance members operably connecting the platform assembly with the at least two ankle cuffs respectively, the at least two elastic resistance members are configured to provide resistance throughout the motion of the calf raise;

wherein the platform assembly is formed by a unitary continuous sheet of rigid material.

2. A calf raise device for exercising the calf muscle group of a user comprising:

a platform assembly having a length extending between a front side and a rear side, the platform assembly comprising a first lower surface having a first lower surface length and a second elevated surface having an elevated second surface length, wherein the first lower surface is configured to support the user's heels during operation and the second surface is configured to support the user's toes during operation throughout a motion of the calf raise; wherein the second elevated surface length is less than the first lower surface length, and wherein the platform assembly is formed by a unitary continuous sheet of rigid material;

at least two ankle cuffs configured to receive respective ankles of the user; and at least two elastic resistance members operably connecting the platform assembly with the at least two ankle cuffs, respectively, in order to provide resistance throughout the motion of the calf raise, wherein each of the at least two elastic resistance members comprises a length of elastic material terminating at a first end and a second end, a first connection means positioned at the first end and a second connection means positioned at the second end, wherein the first connection means is attachably removable to the platform assembly and the second connection means is attachably removable to the respective ankle cuff of the at least two ankle cuffs.

3. The calf raise device of claim 2, further comprising a first base support member and a second base support member for supporting the platform assembly on a flat surface, the first base support member positioned at the front side of the platform assembly and the second base support member positioned at the rear side of the platform assembly.

4. A calf raise device for exercising calf muscles of a user comprising:

a platform assembly comprising a first lower surface and a second elevated surface, wherein the first lower surface is configured to support the user's heels during operation and the second surface is configured to support the user's toes during operation throughout a motion of the calf raise;

at least two ankle cuffs configured to receive ankles of the user;

at least two elastic resistance members operably connecting the platform assembly with the at least two ankle cuffs respectively, the at least two elastic resistance members are configured to provide resistance throughout the motion of the calf raise; and a first base support member and a second base support member for supporting the platform assembly on a flat surface, the first base support member positioned at the front side of the platform assembly and the second base support member positioned at the rear side of the platform assembly, the first base support member and the second base support member further comprise inward extending feet members forming an L shaped cross section for providing increased surface area in contact with the flat surface.

5. A calf raise device for exercising calf muscles of a user comprising:

a platform assembly comprising a first lower surface and a second elevated surface, wherein the first lower surface is configured to support the user's heels during operation and the second surface is configured to support the user's toes during operation throughout a motion of the calf raise;

at least two ankle cuffs configured to receive ankles of the user;

at least two elastic resistance members operably connecting the platform assembly with the at least two ankle cuffs respectively, the at least two elastic resistance members are configured to provide resistance throughout the motion of the calf raise; and a first base support member and a second base support member for supporting the platform assembly on a flat surface, the first base support member positioned at the front side of the platform assembly and the second base support member positioned at the rear side of the platform assembly, the first base support member and the second base support member further comprise outward extending feet members forming an L shaped cross section for providing increased surface area in contact with the flat surface.

* * * * *